US007159526B2

(12) United States Patent
Derochers

(10) Patent No.: US 7,159,526 B2
(45) Date of Patent: Jan. 9, 2007

(54) RETRACTABLE BUMPER SYSTEM AND METHOD

(76) Inventor: Paul P. Derochers, 45 Kwedar Ave., Stoughton, MA (US) 02072

( * ) Notice: Subject to any disclaimer, the term of this patent is extended or adjusted under 35 U.S.C. 154(b) by 0 days.

(21) Appl. No.: 11/117,643

(22) Filed: Apr. 27, 2005

(65) Prior Publication Data

US 2006/0243185 A1 Nov. 2, 2006

(51) Int. Cl.
*B63B 59/02* (2006.01)

(52) U.S. Cl. ..... 114/219; 405/212

(58) Field of Classification Search ..... 114/219, 114/220, 364; 405/211, 212, 213, 215; 267/140
See application file for complete search history.

(56) References Cited

U.S. PATENT DOCUMENTS 212,143 A * 2/1879 Hulster ..... 114/220
1,145,749 A * 7/1915 Claud ..... 114/219
1,593,866 A * 7/1926 Christinzio ..... 114/219
3,854,706 A * 12/1974 Johnston ..... 114/219
3,864,922 A * 2/1975 Dial et al. ..... 405/215
4,650,371 A * 3/1987 Sawaragi et al. ..... 405/211
4,970,980 A * 11/1990 Eisner ..... 114/219

* cited by examiner

*Primary Examiner*—Lars A. Olson
(74) *Attorney, Agent, or Firm*—Bourque and Associates

(57) ABSTRACT

A retractable boat bumper system includes a bumper plate and a positioning mechanism. The bumper plate is selectively operated between a first, retracted position wherein the bumper plate is proximate the boat and a second, extended position wherein the bumper plate is disposed away from the boat. When the boat is secured to a dock or the like, the bumper plate is disposed within the second position and protects the boat from the dock. When underway, the bumper plate is disposed within the first position such that the bumper plate is out of the way.

24 Claims, 9 Drawing Sheets

RETRACTABLE BUMPER SYSTEM AND METHOD

TECHNICAL FIELD

The present invention relates to shock absorbing systems, and more particularly, relates to a retractable shock absorbing system for vessels.

BACKGROUND INFORMATION

It is well known in the boating art to use some type of a bumper system to absorb the force generated when a first boat moves against another object (typically a dock or another vessel in order to prevent damage. While there exist various types of bumper systems, the most common type of bumper system is the fender style bumper. The most common type of fender style bumper has a generally cylindrical shape made from plastic with a generally hollow interior region and is placed between the boat and the other object (most often a dock). As the boat moves towards the dock, the momentum of the boat compresses the fender bumper thereby absorbing the momentum and reducing the impact against experienced by both the boat and the dock.

While the traditional fender bumper is generally effective, it does suffer from several disadvantages. One such disadvantage is that the fender bumpers are typically bulky and must be stored within the vessel when not in use. Since three or more fender bumpers are often needed to properly prevent damage, the fender bumpers often take up much needed storage space.

Another disadvantage of the fender style bumpers is that they are often difficult and time consuming to properly arrange. Large docks and piers 1, FIG. 1, often use very large diameter, generally cylindrical wooden pylons 2. These pylons 2 are often arranged along the outer edge 3 of the dock 1. In order to prevent damage to either the dock 1 or the vessel 5, the fender bumpers 4 must be secured to the pylons 2 between the dock 1 and the vessel 5. Because both the pylons 2 and the fender bumpers 4 are both cylindrical, the natural movement of the vessel 5 often causes the fender bumpers 5 to roll or move out of place thus increasing the potential for damage to the dock 1 and/or the vessel 5. While it is sometimes possible to secure the fender bumpers 4 to the pylons 2 in a manner to prevent the fender bumpers 4 from moving, this is very difficult and very time consuming.

Another common bumper system includes a dock bumper strip. The bumper strip generally includes a shock absorbing material that is placed and permanently secured along the like contact area of a dock, for example, along a pylon or along the outer edge of the dock. Unlike the fender bumpers described above, the benefit to a dock bumper strip is that there is no need to store bulky bumpers.

However, bumper strips also suffer from several disadvantages. Firstly, in order to take advantage of the benefit of bumper strips (i.e., not having to store fender bumpers), a boater must know ahead of time whether their destination is equipped with bumper strips. Because the benefit of the bumper strips is that the boater does not need to carry along fender bumpers, the boater must make sure that their destination is in fact equipped with bumper strips. In the event the boater is mistaken and the destination does not have bumper strips or their destination changes after leaving port, then the boater is left without any way of preventing damage to their vessel. Moreover, because bumper strips are secured to a dock, bumper strips are not useful when securing a first vessel to an adjacent vessel (commonly referred to as hotelling).

Accordingly, what is needed is an easy to use method and apparatus of protecting a vessel from damage. The method and apparatus should be capable of repeatedly absorbing the force generated by wind, waves, and movement. The method and apparatus should preferably work in virtually all situations and should not require the user to know the specific details of their destination ahead of time. Additionally, the method and apparatus should preferably not take up much needed storage space within the vessel.

It is important to note that the present invention is not intended to be limited to a system or method which must satisfy one or more of any stated objects or features of the invention. It is also important to note that the present invention is not limited to the preferred, exemplary, or primary embodiment(s) described herein. Modifications and substitutions by one of ordinary skill in the art are considered to be within the scope of the present invention, which is not to be limited except by the following claims.

SUMMARY

According to one embodiment, the present invention features a bumper system for a vessel. The bumper system includes a bumper plate (preferably having a layer of shock-absorbing material) and a positioning mechanism secured to the bumper plate. The position mechanism moves the bumper plate between a retracted position wherein the bumper plate is disposed proximate the vessel and an extended position wherein the bumper plate is disposed distal from the vessel. A controller may be provided for selecting between the extended and the retracted positions.

The positioning mechanism preferably includes at least one cylinder and at least one piston movably disposed within the cylinder. A first end of the cylinder is adapted to be secured to the vessel and a second end of the piston is adapted to the bumper plate. The cylinder may include a hydraulic cylinder or a pneumatic cylinder. Alternatively, the positioning mechanism may include a cable and pulley system.

The positioning mechanism optionally includes at least one biasing device. The biasing device is adapted to absorb a force transmitted through the bumper plate. According to one embodiment, the biasing device urges the bumper plate towards the extended position. The cylinder may be movably secured to a mounting flange such that the cylinder is adapted to move in a direction substantially parallel to a longitudinal axis of the cylinder. The biasing device urges the cylinder along the longitudinal axis towards the extended position.

According to another embodiment, the present invention features a boat bumper for use with a vessel. The boat bumper includes a bumper plate, a positioning mechanism, and a positioning selector. The positioning mechanism is adapted to be secured to the vessel and the bumper plate and includes at least one cylinder and at least one piston disposed within the cylinder. The positioning selector includes a first position wherein the piston is substantially disposed within the cylinder and a second position wherein the piston is extended from the cylinder relative to the first position.

BRIEF DESCRIPTION OF THE DRAWINGS

These and other features and advantages of the present invention will be better understood by reading the following detailed description, taken together with the drawings wherein.

DETAILED DESCRIPTION OF THE PREFERRED EMBODIMENTS

Figure 1:
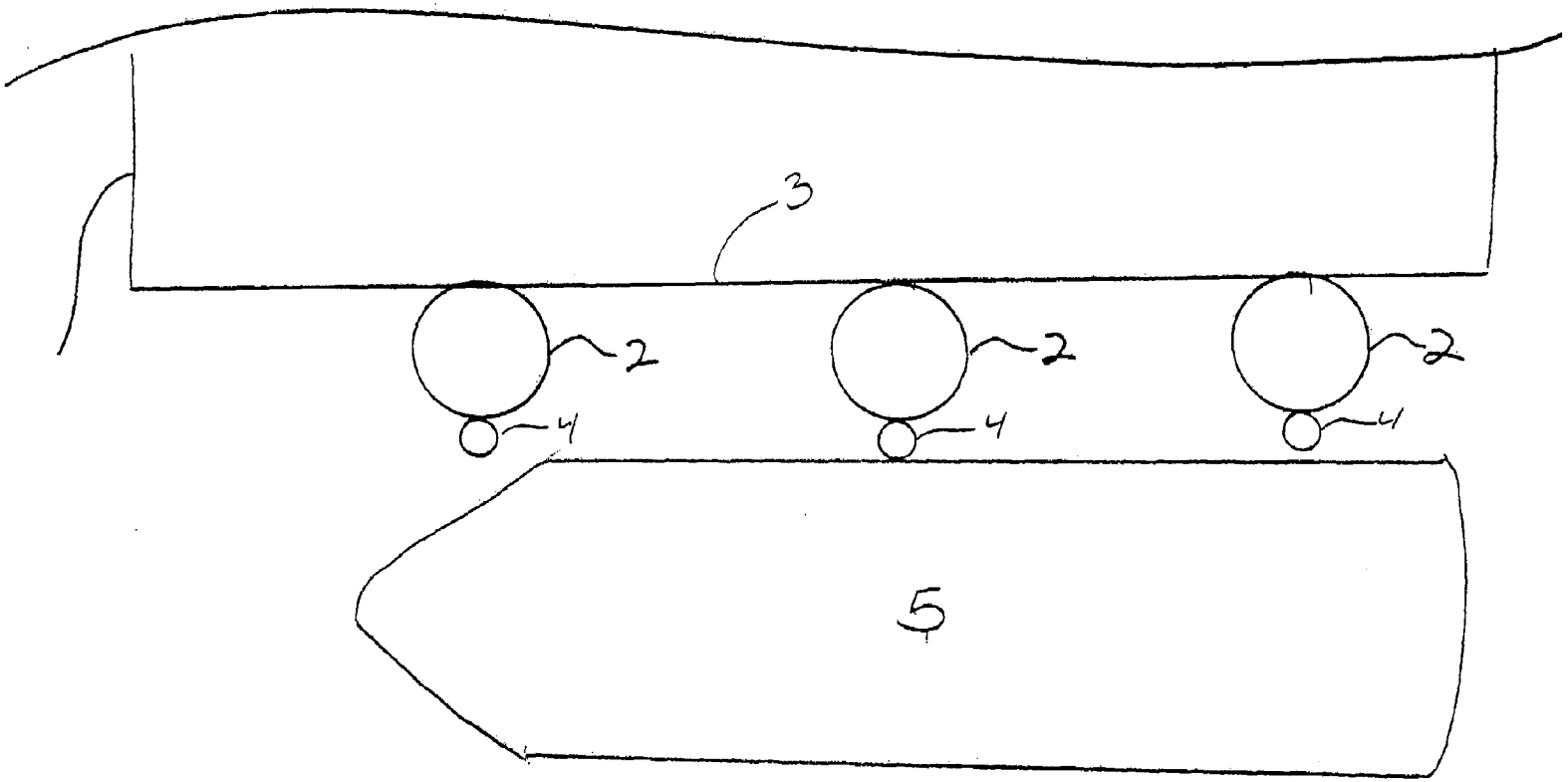
Fig 1 (Prior Art)
FIG. 1 is a top plan view of a typical prior art fender bumper system.
Figure 2A:
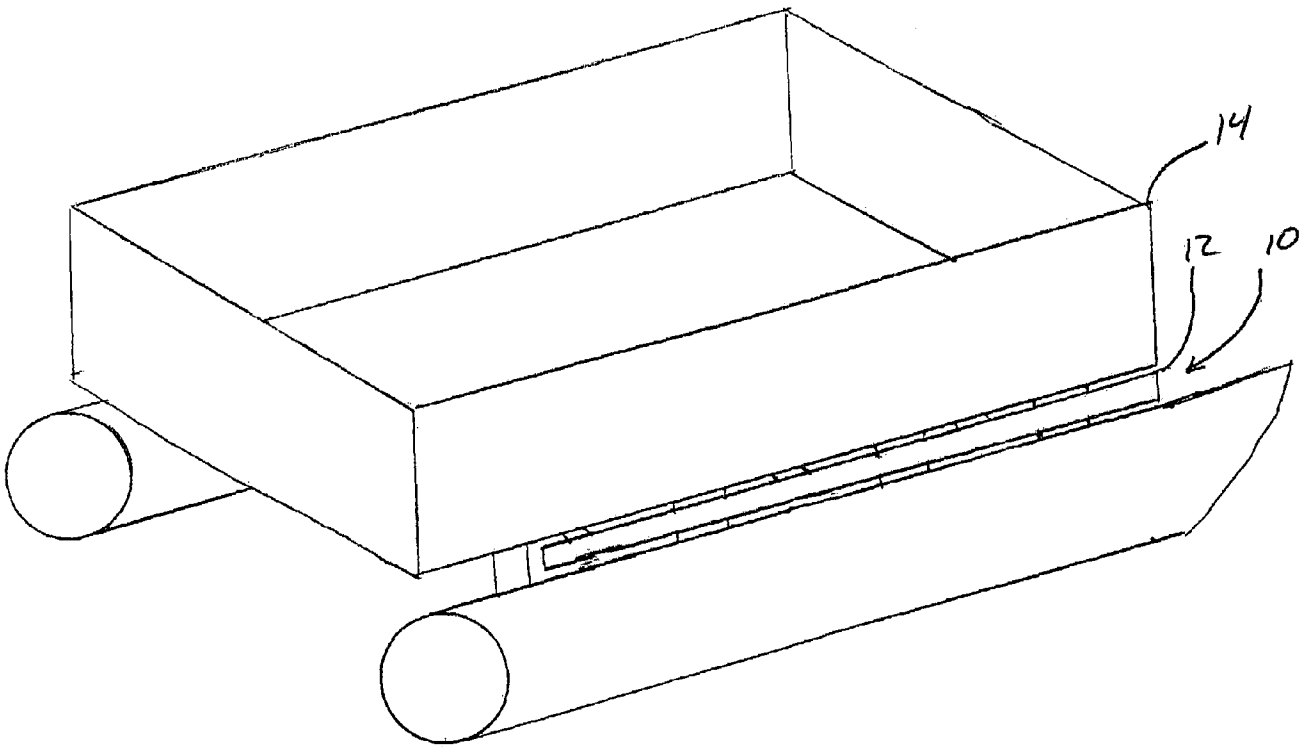
FIG. 2*a* is a side perspective view of one embodiment of the retractable shock absorbing system in combination with a vessel shown in the retracted position according to the present invention.
Figure 2B:
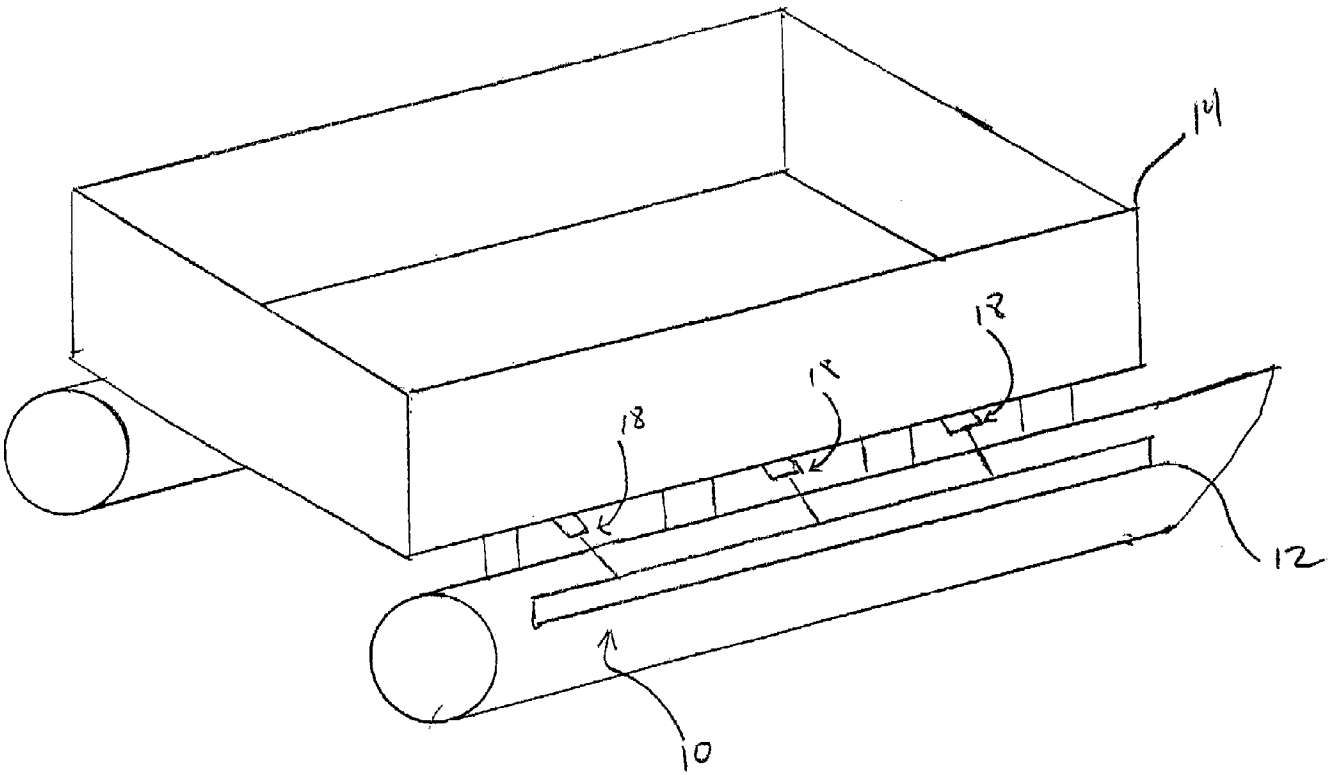
FIG. 2*b* is a side perspective view of one embodiment of the retractable shock absorbing system in combination with a vessel shown in the extended position according to the present invention.

According to one embodiment, the present invention features a retractable shock absorbing system 10, FIG. 2, having a bumper plate 12 moveable between a first, retracted position shown in FIG. 2*a* and a second, extended position shown in FIG. 2*b*. While the retractable shock absorbing system 10 will be described in combination with a boat (and in particular a pontoon style boat), this is not a limitation of the present invention unless otherwise specifically recited as such in the following claims. Any modification(s) necessary for compatibility with another style vessels and objects (for example, but not limited to, personal watercraft, various boats, aircraft, or the like) are considered within the knowledge of one skilled in the art.

As shown in FIG. 2*a*, when in the retracted position the bumper plate 12 of the retractable shock absorbing system 10 is substantially contained within the hull of the boat 14 such that the bumper plate 12 is out of the way. In the preferred embodiment, the bumper plate 12 is contained in an interior cavity of the boat 14. In the extended position, the bumper plate 12, FIGS. 2*b* and 3, of the retractable shock absorbing system 10 is preferably disposed beyond an outer, vertical plane P of the boat 14 such that the bumper plate 12 contacts an adjacent object (for example, but not limited to, a pylon, a dock, another boat, or the like) and prevents the rest of the boat 14 from coming in contact with the object. Those skilled in the art will readily understand that the distance from the outer, vertical plane P of the boat 14 is variable and depends on the intended application of the retractable shock absorbing system 10.

The bumper plate 12 is constructed from any material having sufficient strength to withstand the forces generated during normal use including, but not limited to, metal, plastic, rubber, and the like. The bumper plate 12 also preferably includes a shock-absorbing layer 16, FIG. 3, such as neoprene, polyethylene, a bladder, or the like. The shock-absorbing layer 16 aids in dissipating the force and may be disposed along the outer and/or the inner surface of the bumper plate 12.

In the preferred embodiment, the bumper plate 12 includes a generally "L" shape cross-section. The top surface 13 of the bumper plate 12 forms a step surface that facilitates boarding/exiting by providing a surface upon which the user may step. The top surface 13 optionally includes a layer of high traction material to minimize the risk of slipping. While the dimensions of the bumper plate will vary depending upon the specifics of the installation, for illustrative purposes only the bumper plate 12 is approximately 10 feet long by approximately 11 inches deep and approximately 4 inch thick, and the top surface 13 is approximately 7 inches wide by approximately ¼ inch thick by approximately 10 feet long.

The bumper plate 12 may also optionally include one or more cleats or the like 15. The cleats 15 may be disposed anywhere along the bumper plate 12. In the preferred embodiment, the bumper plate 12 also include a retractable dock line assemble 17. The retractable dock line assemble 17 may also be disposed anywhere along the bumper plate 12 and includes any means known to those skilled in the art for retracting a cable or rope. The retractable dock line assemble 17 may alternatively be stored within the cavity of the boat 14.

Figure 3:
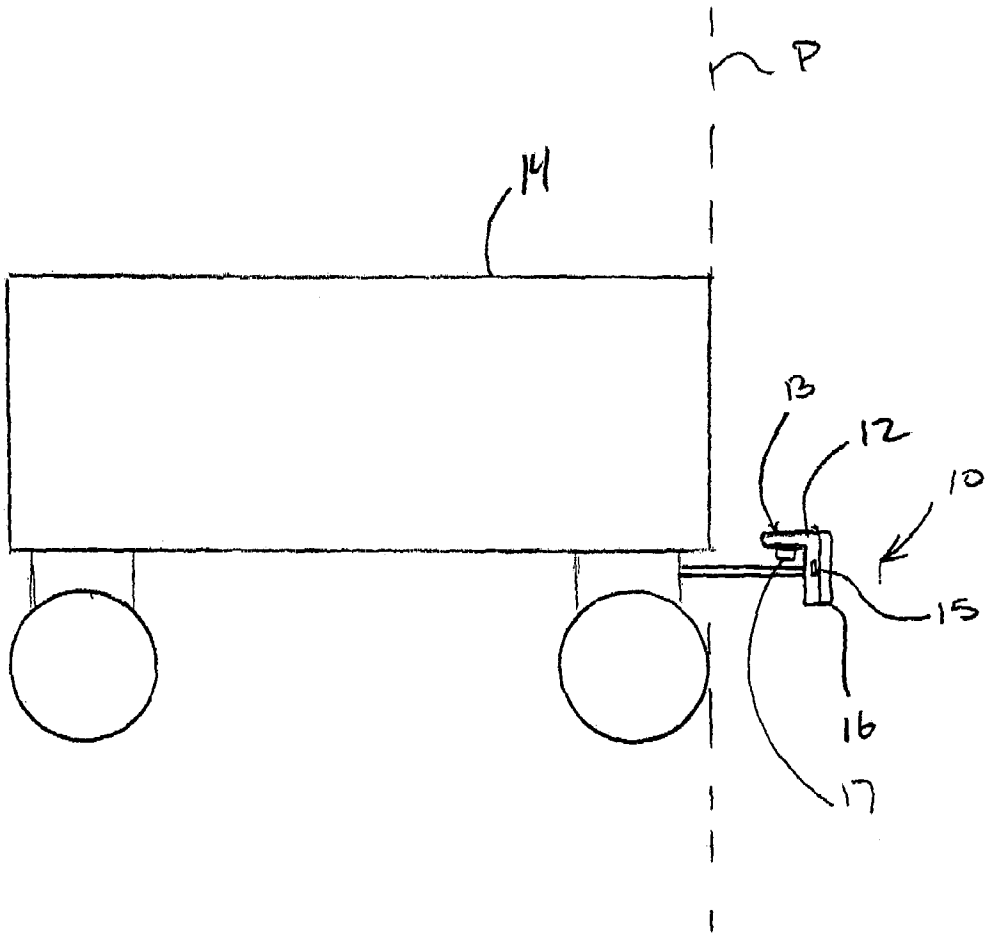
FIG. 3 is an end perspective view of one embodiment of the retractable shock absorbing system in combination with a vessel shown in the retracted position according to the present invention.

According to the preferred embodiment, the bumper plate 12 of the retractable shock absorbing system 10 is moved between the retracted (FIG. 2*a*) and the extended (FIGS. 2*b* and 3) position using a hydraulic system 18 and a switch 40. Alternatively, the hydraulic system may include a pneumatically operated cylinder/piston, a cable system, electric motors, or any other means known to those skilled in the art for moving the bumper plate 12 between the retracted (FIG. 2*a*) and extended positions (FIGS. 2*b* and 3).

Figure 4:
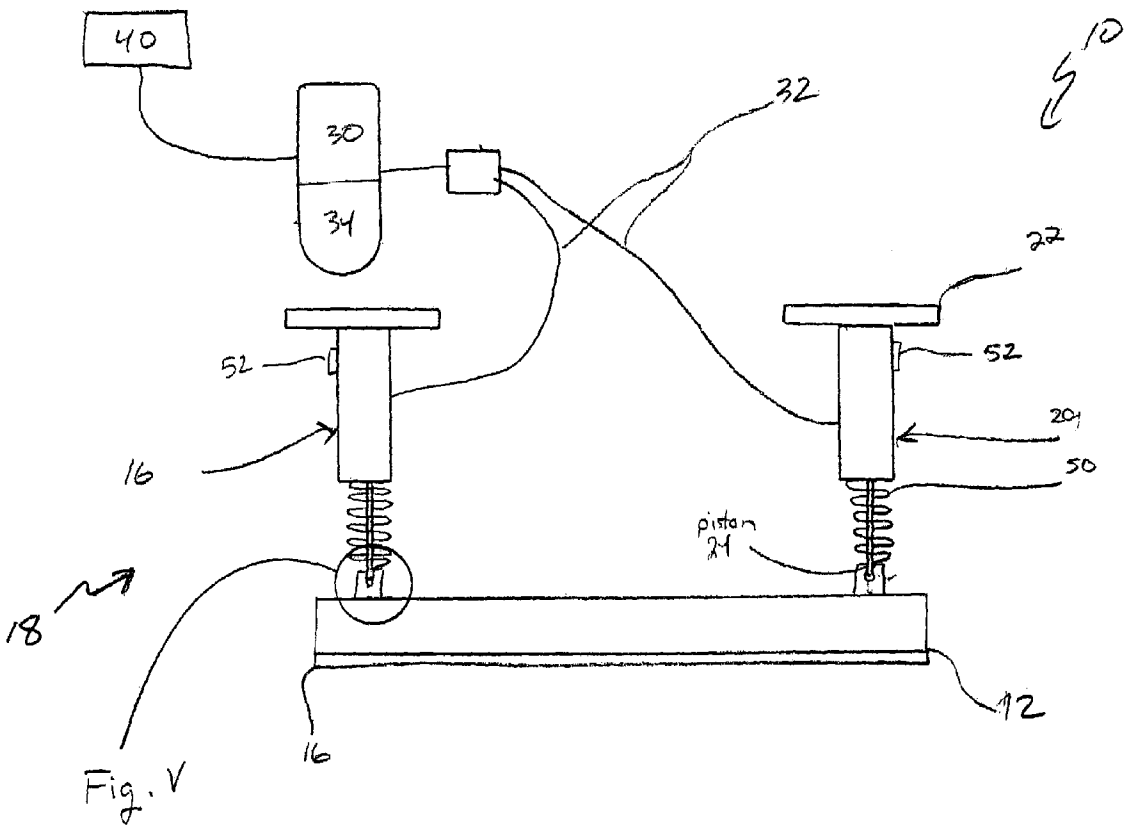
FIG. 4 is a top plan view of one embodiment of the retractable shock absorbing system according to the present invention.
Figure 5:
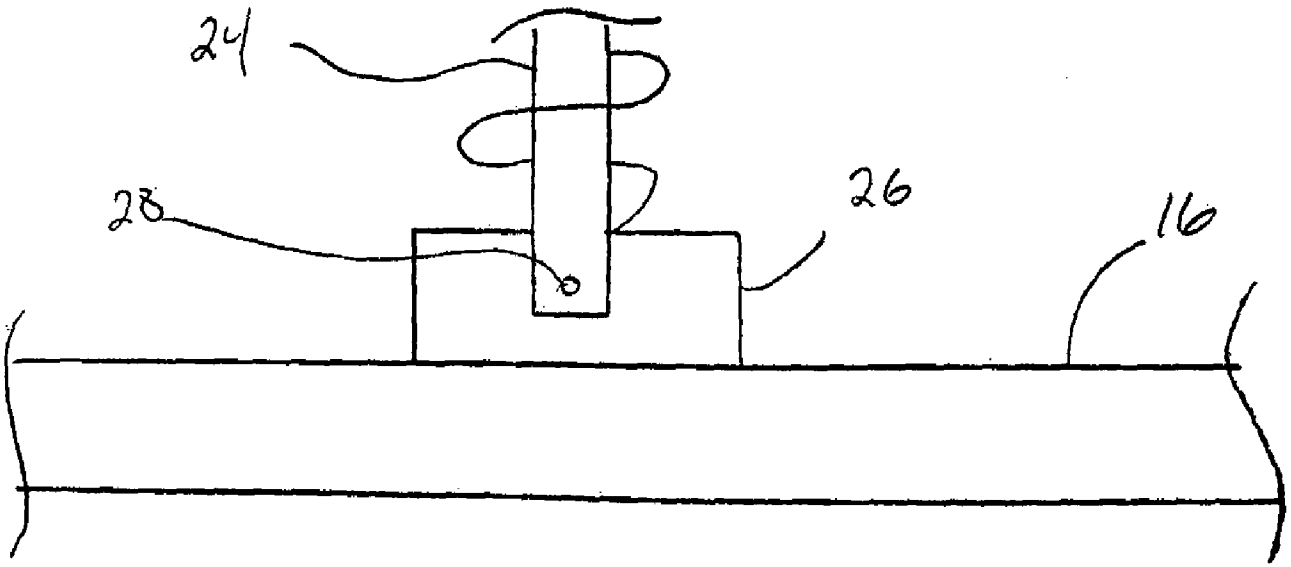
FIG. 5 is a top plan view of one embodiment of the piston mounting flange according to the present invention.

Referring specifically to FIG. 4, the retractable shock absorbing system 10 preferably includes one or more hydraulic cylinders 20 disposed along the length of the bumper plate 12 fluidly coupled to a hydraulic pump 30 and reservoir 34 using suitable lines 32 and one or more actuation valves 36. In the preferred embodiment, the hydraulic cylinders/pistons 20, 24 are preferably arranged between the floor mounting brackets of the boat 14. This space is otherwise unused and therefore does not reduce the storage space of the boat 14. Any modifications necessary are considered within the knowledge of one of ordinary skill in the art.

While the present invention is illustrated and primarily described wherein the piston 24 is connected to the bumper plate 12, those skilled in the art will readily recognize that cylinder 20 may connected to the bumper plate 12. Alternatively, the cylinder/piston 20, 24 may optionally act upon linkage (not shown) in order to move the bumper plate 12.

Each of the hydraulic cylinders 20 is secured to the boat 14 preferably with a mounting flange 22. The hydraulic cylinders 20 include a movable piston 24 at least partially disposed within the hydraulic cylinders 20. A distal end of the piston 24 is coupled to the bumper plate 12, preferably with a mounting flange 26 secured to the bumper plate 12. In the exemplary embodiment, the piston 24 is secured to the mounting flange 26 using a pivot 28. The pivot 28 allows a region of the bumper plate 12 to move relative to the boat 14 without creating undue stress on the retractable shock absorbing system 10.

The retractable shock absorbing system 10 optionally includes a biasing device 50, preferably a coil spring, which absorbs some of the force generated during use. According to one embodiment, coil spring 50 acts against the bumper plate 12 to force the bumper plate 12 into the extended position. In the extended position, the actuation valve 36 is preferably open, the hydraulic pump 30 is off, and the piston 24 is substantially free to move within the hydraulic cylinder 20.

This arrangement reduces the likelihood of damaging the hydraulic system 18 because the coil spring 50 absorbs the forces generated during use rather than the hydraulic system 18. Also, the damping and rebound of the retractable shock absorbing system 10 can easy be changed for different applications. For example, smaller boats will tend to require less damping and rebound compared to larger boats. By adjusting the biasing force of the coil spring 50 as well as the hydraulic pressure via actuation valve 30, the damping and rebound of the retractable shock absorbing system 10 can easily be changed.

To retract the retractable shock absorbing system 10, the hydraulic pump 30 is activated and the hydraulic cylinder/piston 20, 24 overcomes the force generated by the biasing device 50 and retracts the piston 24 and the bumper plate 12. A locking device 52 optionally prevents the piston 24 from extending once the retractable shock absorbing system 10 is in the retracted position. It is important to note that the biasing device 50 is optional. In the event the biasing device is not included, the forces generated during use maybe absorbed by the bumper plate 12, the shock-absorbing layer 16, and/or the hydraulic system 18.

Figure 6:
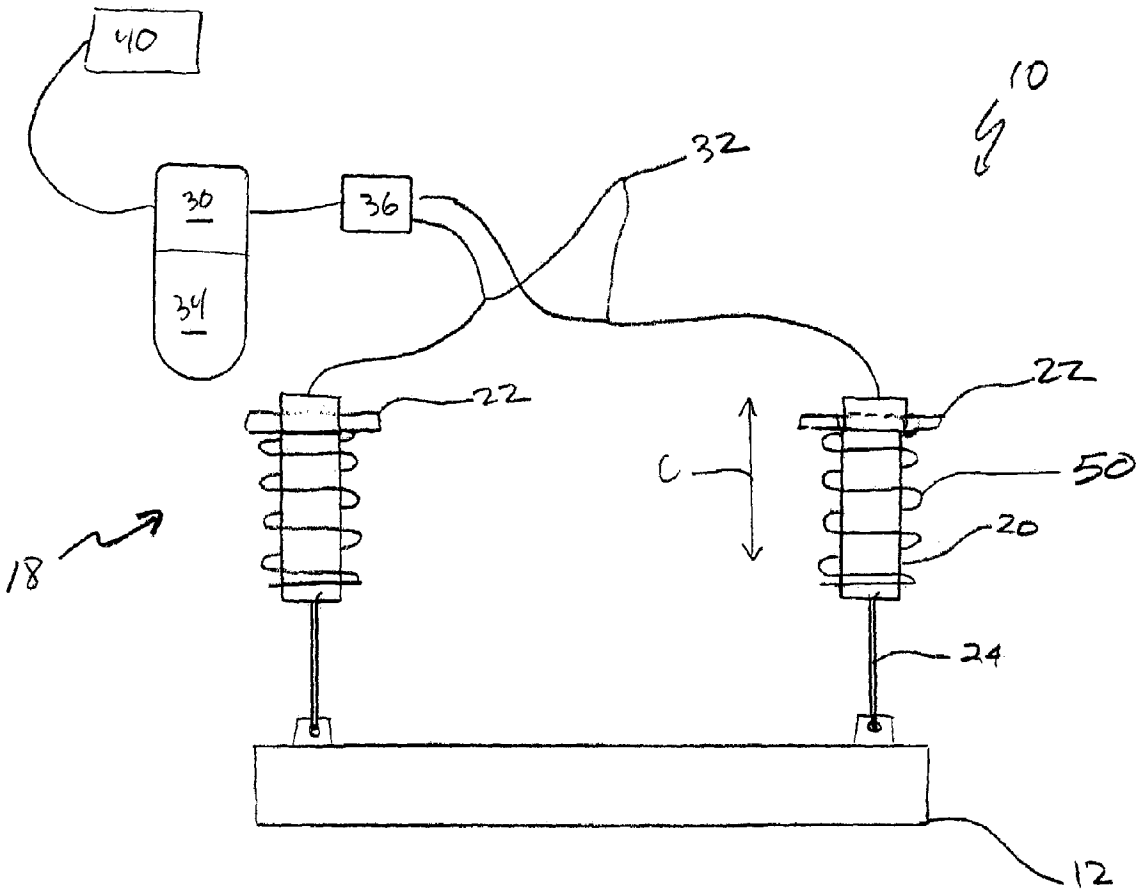
FIG. 6 is a top plan view of another embodiment of the retractable shock absorbing system according to the present invention

According to another embodiment, the retractable shock absorbing system 10, FIG. 6, includes a hydraulic system 18 substantially as described above except that the biasing device 50 urges the hydraulic cylinder 20 against the mounting flange 22. The piston 24 is extends bumper plate 12 from the retracted position (FIG. 2*a*) and into the extended position (FIGS. 2*b* and 3). Once in the extended position, forces exerted against the bumper plate cause the spring 50 to compress. This, in turn, causes the hydraulic cylinder 20 to move in the direction of arrow C with respect to the mounting flange 22. To retract the bumper plate 12, the piston 24 is retracted within the hydraulic cylinder 20 by the pump 30 and the actuation valve 36.

Figure 7:
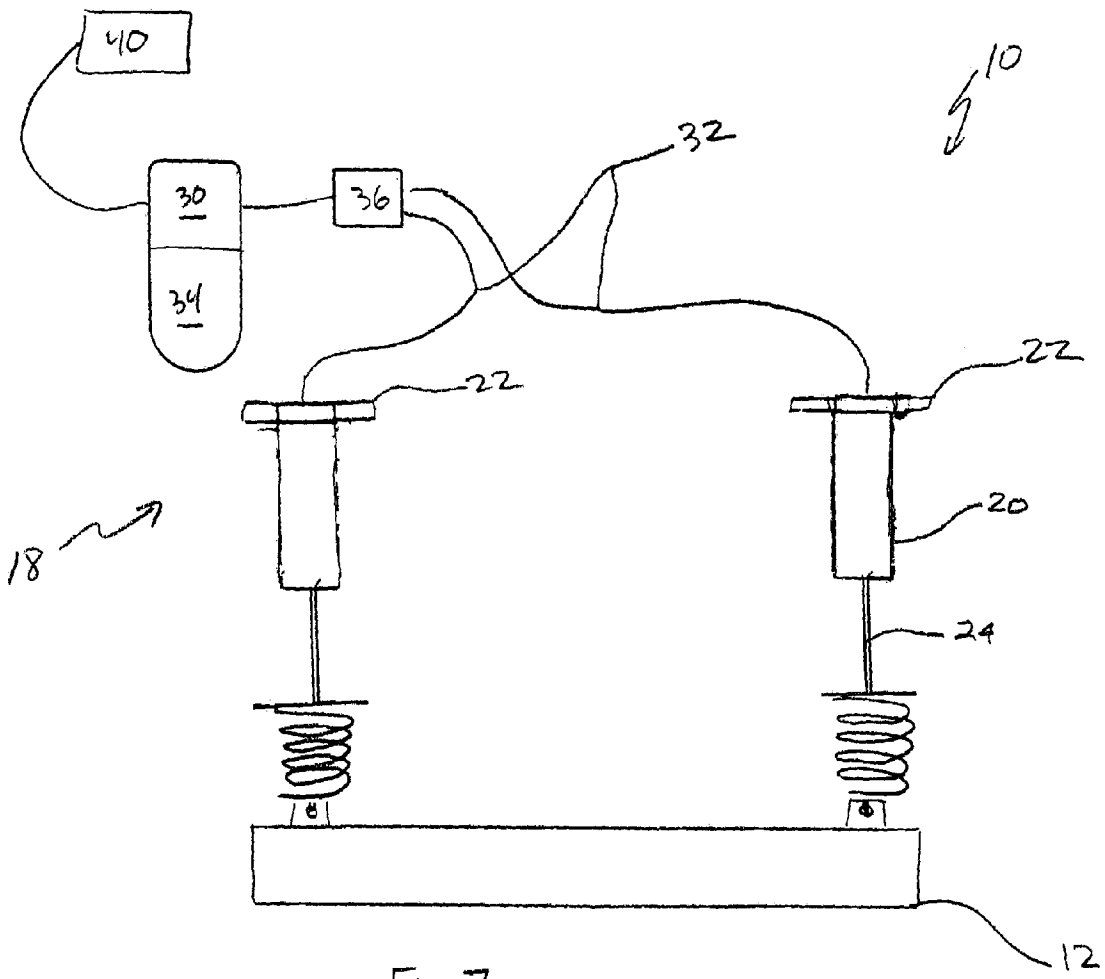
FIG. 7 is a top plan view of yet another embodiment of the retractable shock absorbing system according to the present invention.

According to a further embodiment of the present invention, the retractable shock absorbing system 10, FIG. 7, includes a hydraulic system 18 substantially as described above except that the biasing device 50 is disposed between the piston 24 and the bumper plate 12. According to this embodiment, the cylinder and piston 20, 24 move the bumper plate 12 and biasing device 50 between the extended position and retracted position. The force exerted against the bumper plate 12 during normal use is substantially absorbed by the biasing device 50.

Figure 8:
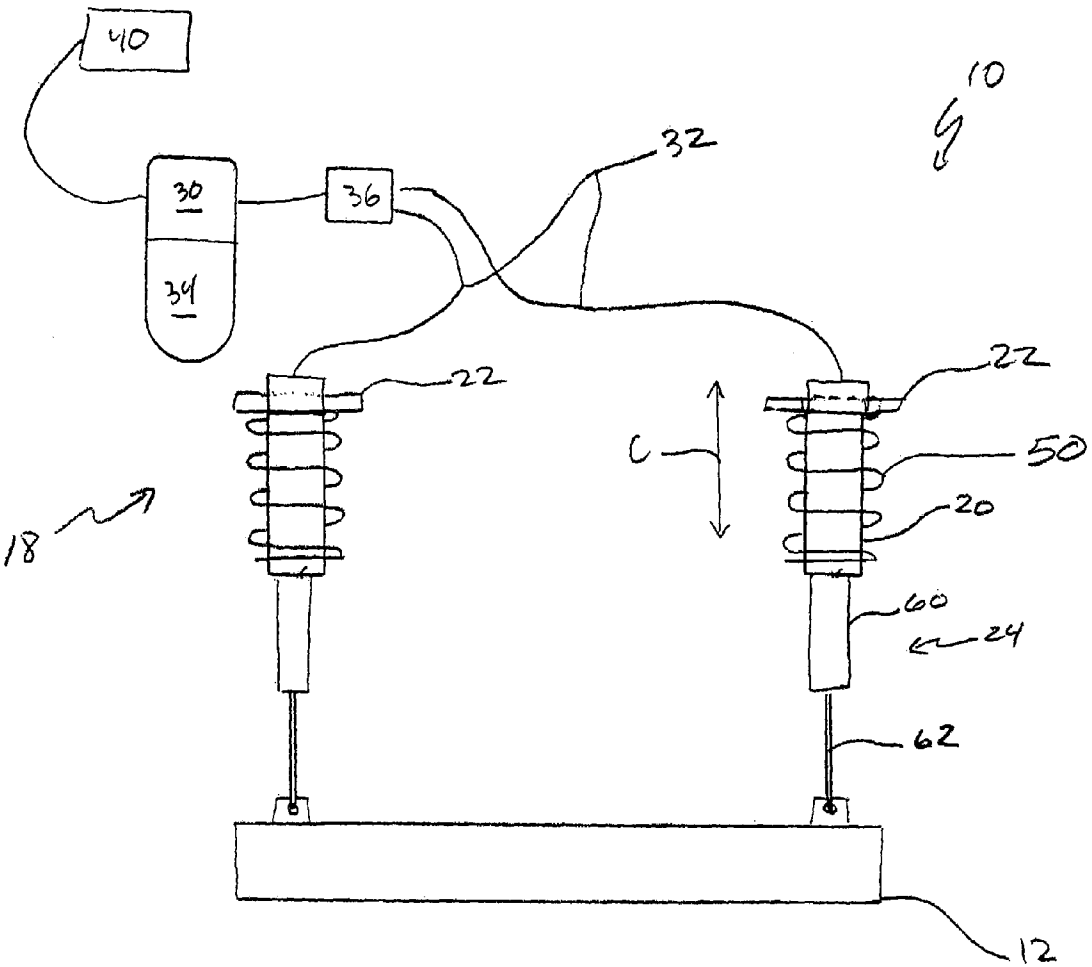
FIG. 8 is a top plan view of a further embodiment of the retractable shock absorbing system including a telescoping piston according to the present invention.

It should be noted that any of the foregoing embodiments may optionally include a telescoping or extendable piston 24, FIG. 8. In the preferred embodiment, the piston 24 includes two or more telescoping segments 60, 62. The telescoping piston 24 allows the distance between the boat 14 and the bumper plate 12 to be adjusted. For example, in the event of an obstruction extending outwardly from the dock 3 (for example a sign, post, cleat, rough water, or the like), the telescoping piston 24 may be extended in order to keep the boat 14 further away from the dock 3 and avoid damaging the boat 14. Alternatively, in the event of no obstructions and calm water, the telescoping piston 24 may be minimized thereby allowing the boat 14 to be closer to the dock 3 in order to facilitate boarding and exiting the boat 14.

From the foregoing, it will be understood that the present invention features systems and methods for providing a retractable shock absorbing system that is easy to use and protects an object, such as a boat, from damage. The retractable shock absorbing system includes an extended position wherein the bumper plate prevents damage to an object and a retracted position wherein the bumper plate is substantially out of the way. The retractable shock absorbing system also includes means for moving the bumper plate between the extended and retracted positions such as, but not limited to, a hydraulic system, cable system, or electric motors. The present invention Is capable of repeatedly absorbing the force generated by wind, waves, and movement and does not require the user to know the specific details of their destination ahead of time. Additionally, the present invention does not take up much needed storage space within the vessel.

As mentioned above, the present invention is not intended to be limited to a system or method which must satisfy one or more of any stated or implied object or feature of the invention and should not be limited to the preferred, exemplary, or primary embodiment(s) described herein. The foregoing description of a preferred embodiment of the invention has been presented for purposes of illustration and description. It is not intended to be exhaustive or to limit the invention to the precise form disclosed. Obvious modifications or variations are possible in light of the above teachings. The embodiment was chosen and described to provide the best illustration of the principles of the invention and its practical application to thereby enable one of ordinary skill in the art to utilize the invention in various embodiments and with various modifications as is suited to the particular use contemplated. All such modifications and variations are within the scope of the invention as determined by the claims when interpreted in accordance with breadth to which they are fairly, legally and equitably entitled.

The invention claimed is:

1. A bumper system for a vessel comprising:

a bumper plate having a generally "L" shaped cross-section formed by first and second portions, said first portion of said generally "L" shaped bumper plate disposed horizontally proximate a top region of said bumper and configured to serve as a step for entrance to and exit from said vessel, said second portion coupled to said first portion forming said generally "L" shaped cross-section and configured to serve as a bumper element; and a positioning mechanism secured to said bumper plate and said vessel, said position mechanism configured to move said bumper plate between a retracted position wherein said bumper plate is disposed proximate said vessel when said bumper system is not in use and an extended position wherein said bumper plate is disposed generally distal from said vessel when said bumper system is in use and wherein in said distal position, said bumper plate is configured to serve both as a bumper and a step.

2. The bumper system as claimed in claim 1 wherein said positioning mechanism includes at least one cylinder and at least one piston movably disposed within said at least one cylinder, wherein a first end of said cylinder is adapted to be secured to said vessel and a second end of said piston is adapted to said bumper plate.

3. The bumper system as claimed in claim 2 wherein said cylinder includes a hydraulic cylinder.

4. The bumper system as claimed in claim 2 wherein said cylinder includes a pneumatic cylinder.

5. The bumper system as claimed in claim 1 wherein said positioning mechanism includes a cable and pulley system.

6. The bumper system as claimed in claim 1 wherein said positioning mechanism further includes at least one biasing device, said biasing device adapted to absorb a force transmitted through said bumper plate.

7. The bumper system as claimed in claim 6 wherein said biasing device urges said bumper plate towards said extended position.

8. The bumper system as claimed in claim 6 wherein said positioning mechanism includes at least one cylinder and at least one piston movably disposed within said at least one cylinder, wherein a first end of said cylinder is adapted to be secured to said vessel and a second end of said piston is adapted to said bumper plate.

9. The bumper system as claimed in claim 8, wherein said biasing device urges said bumper plate towards said extended position.

10. The bumper system as claimed in claim 8, wherein said cylinder is movably secured to a mounting flange such that said cylinder is adapted to move in a direction substantially parallel to a longitudinal axis of said cylinder, wherein said biasing device urges said cylinder along said longitudinal axis towards said extended position.

11. The bumper system as claimed in claim 1 wherein said bumper plate included a layer of shock-absorbing material.

12. The bumper system as claimed in claim 1 wherein said positioning mechanism further includes a controller for selecting between said extended and said retracted positions.

13. The bumper system as claimed in claim 1 wherein said bumper plate is secured to said positioning mechanism about a pivot.

14. The bumper system as claimed in claim 1 wherein said positioning mechanism includes a telescoping mechanism.

15. The bumper system as claimed in claim 14 wherein said telescoping mechanism includes a cylinder and at least two telescoping segments.

16. The bumper system of claim 1 wherein said first portion of said bumper plate includes a top region, and wherein at least a portion of said top region of said first portion of said bumper plate includes a high traction material to prevent slipping.

17. A boat bumper system secured to a vessel comprising:

a bumper plate, having a generally "L" shaped cross-section formed by first and second portions, said first portion of said generally "L" shaped bumper plate disposed horizontally proximate a top region of said bumper and configured to serve as a step for entrance to and exit from said vessel, said second portion coupled to said first portion forming said generally "L" shaped cross-section and configured to serve as a bumper element, said bumper plate including a layer of shock-absorbing material;

means for moving said bumper plate between a retracted position wherein said bumper plate is disposed proximate said vessel and an extended position wherein said bumper plate is disposed distal from said vessel, wherein in said distal position, said bumper plate is configured to serve both as a bumper and a step; and a positioning selector coupled to said means for moving for allowing a user to choose between an in-use position wherein said bumper plate is disposed in said extended position and a non-use position wherein said bumper plate is disposed in said retracted position.

18. The boat bumper as claimed in claim 17 wherein said means for moving said bumper plate includes at least one cylinder and piston.

19. The boat bumper as claimed in claim 18 further including at least one spring, said at least one spring absorbing a force exerted against said bumper plate during use.

20. The boat bumper as claimed in claim 19 wherein said at least one spring urges said bumper plate towards said extended position.

21. The boat bumper as claimed in claim 17 wherein said means for moving said bumper plate includes a cable and pulley system.

22. A boat bumper for use with a vessel comprising:

a bumper plate having a generally "L" shaped cross-section formed by first and second portions, said first portion of said generally "L" shaped bumper plate disposed horizontally proximate a top region of said bumper and configured to serve as a step for entrance to and exit from said vessel, said second portion coupled to said first portion forming said generally "L" shaped cross-section and configured to serve as a bumper element,;

a positioning mechanism adapted to be secured to said vessel and said bumper plate, said positioning mechanism including at least one cylinder and at least one piston disposed within said at least one cylinder; and a positioning selector, said positioning including a first position wherein said at least one piston is substantially disposed within said at least one cylinder and a second position wherein said at least one piston is extended from said at least one cylinder relative to said first position.

23. The boat bumper as claimed in claim 22 wherein said positioning mechanism further includes at least one biasing device, said at least one biasing device absorbing a force exerted against said bumper plate during use.

24. A bumper system for a vessel comprising:

a bumper plate having a generally "L" shaped cross-section formed by first and second portions, said first portion of said generally "L" shaped bumper plate disposed horizontally proximate a top region of said bumper and configured to serve as a step for entrance to and exit from said vessel, said second portion coupled to said first portion forming said generally "L" shaped cross-section and configured to serve as a bumper element,;

a positioning mechanism secured to said bumper plate, said position mechanism configured to move said bumper plate between a retracted position wherein said bumper plate is disposed proximate said vessel and an extended position wherein said bumper plate is disposed distal from said vessel; and a controller for selecting between said extended and said retracted positions.

* * * * *